United States Patent [19]

Lacher

[11] 4,303,502

[45] Dec. 1, 1981

[54] HERB PROCESSING MACHINE

[76] Inventor: Douglas M. Lacher, 20244 Hazelcrest, Palatine, Ill. 60067

[21] Appl. No.: 168,711

[22] Filed: Jul. 14, 1980

[51] Int. Cl.[3] ..... B03B 1/00

[52] U.S. Cl. ..... 209/3; 209/139 R; 209/149; 131/312; 131/329; 241/60

[58] Field of Search ..... 209/3, 133, 138, 139 R, 209/477, 479, 149; 131/109 B, 110, 122, 146, 122, 127, 312, 313, 318, 329; 241/47, 57, 60

[56] References Cited

U.S. PATENT DOCUMENTS

| | | | |
|---|---|---|---|
| 149,434 | 4/1874 | Burdick | 209/139 R |
| 255,747 | 3/1882 | Wolf | 209/138 X |
| 288,550 | 11/1883 | Coombes | 209/139 R X |
| 816,560 | 4/1906 | Cooley | 209/138 |
| 933,532 | 9/1909 | Cooper | 209/139 R X |
| 1,797,434 | 3/1931 | McLaughlin | 209/138 X |
| 2,091,514 | 8/1937 | Meston | 209/139 R |
| 2,329,900 | 9/1943 | Hermann | 209/139 R |
| 3,086,533 | 4/1963 | Touton | 131/140 |
| 3,245,145 | 4/1966 | Koch | 131/146 |
| 3,269,189 | 8/1960 | Monk | 209/139 R X |
| 3,362,414 | 1/1968 | Wochnowski | 131/146 |
| 3,386,451 | 6/1968 | Pietrucci | 131/146 |
| 3,450,139 | 6/1969 | Pietrucci | 209/133 X |
| 3,548,839 | 12/1970 | Karlsson | 131/146 |
| 3,557,799 | 1/1971 | Koch | 131/146 |
| 3,661,159 | 5/1972 | Pietrucci | 131/146 |
| 3,904,515 | 9/1975 | MacKenzie | 209/3 |
| 4,101,419 | 7/1978 | Bergman | 209/160 |

FOREIGN PATENT DOCUMENTS

| | | | |
|---|---|---|---|
| 455775 | 11/1928 | Fed. Rep. of Germany | 209/139 R |
| 8538 | 7/1927 | United Kingdom | 209/138 |
| 976904 | 12/1964 | United Kingdom | 131/146 |
| 634788 | 11/1978 | U.S.S.R. | 241/47 |

*Primary Examiner*—Robert Halper

*Attorney, Agent, or Firm*—Hill, Van Santen, Steadman, Chiara & Simpson

[57] ABSTRACT

A portable batch type herb processing machine has a housing sized to fit on a counter top and is easily carried by a single person. Leafy portions of herbal material are separated from stems, seeds and twigs by introducing the herbal material into a selectively expandable stripping chamber where the leafy material is sheared from the stems, seeds and twigs. An upwardly directed air stream carries the light leafy material through a selectively expandable conduit into a collection chamber where the leaf material may be removed for further processing or use. The air stream can then be selectively increased to flush the stems, seeds and twigs through the conduit into the collection chamber for removal therefrom. The expandable stripping chamber and conduit may be selectively detached to provide access to the interior of the machine.

9 Claims, 7 Drawing Figures

FIG. 1
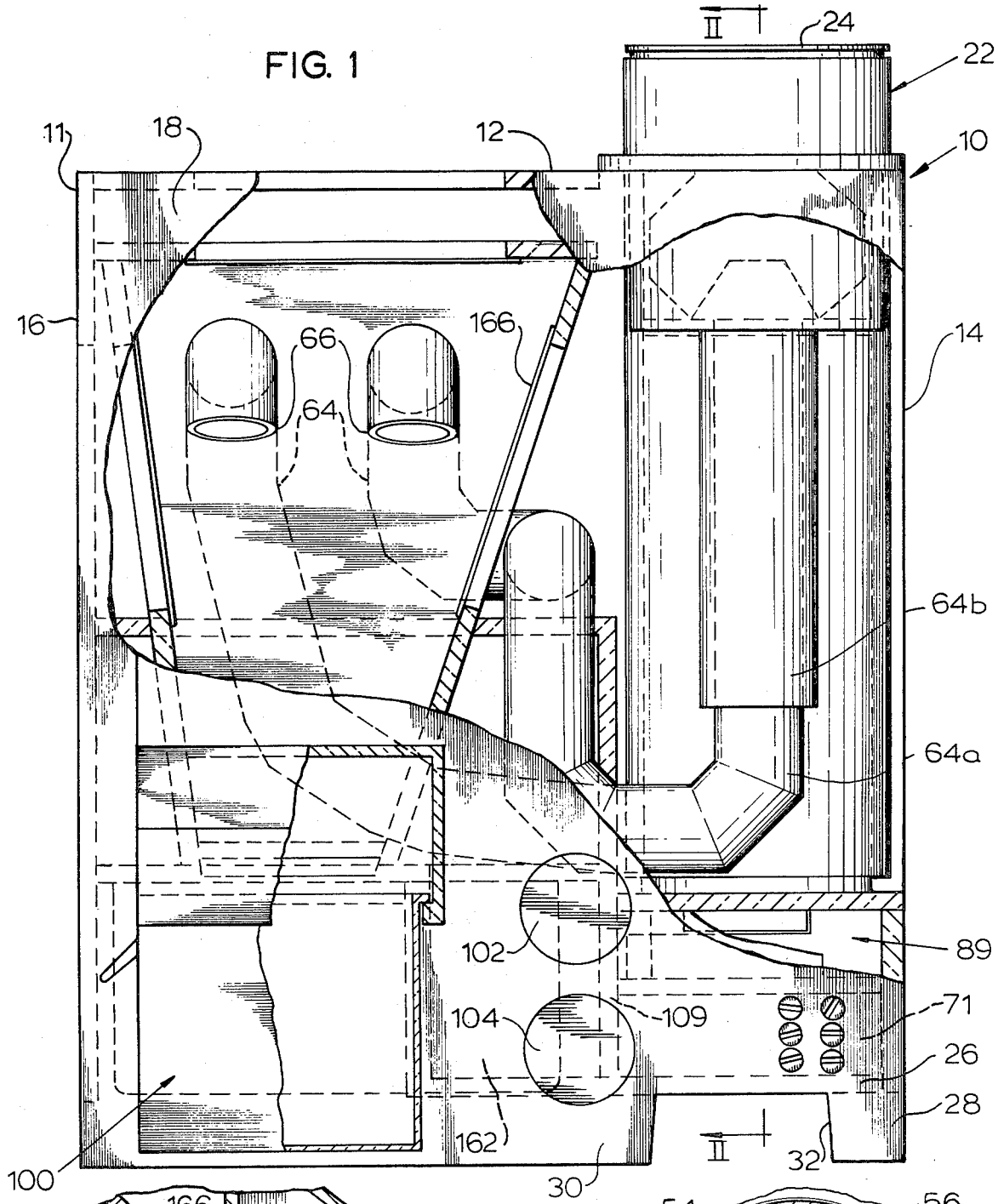
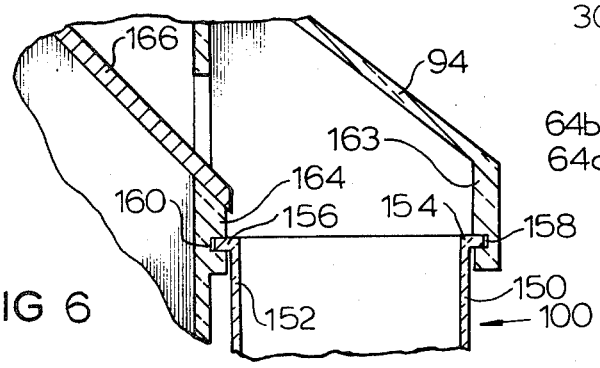
FIG 6
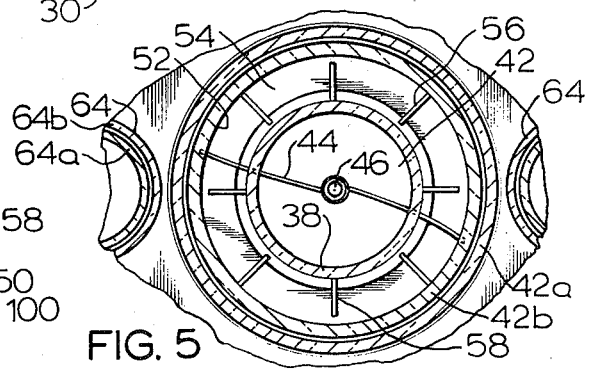
FIG. 5

FIG. 3
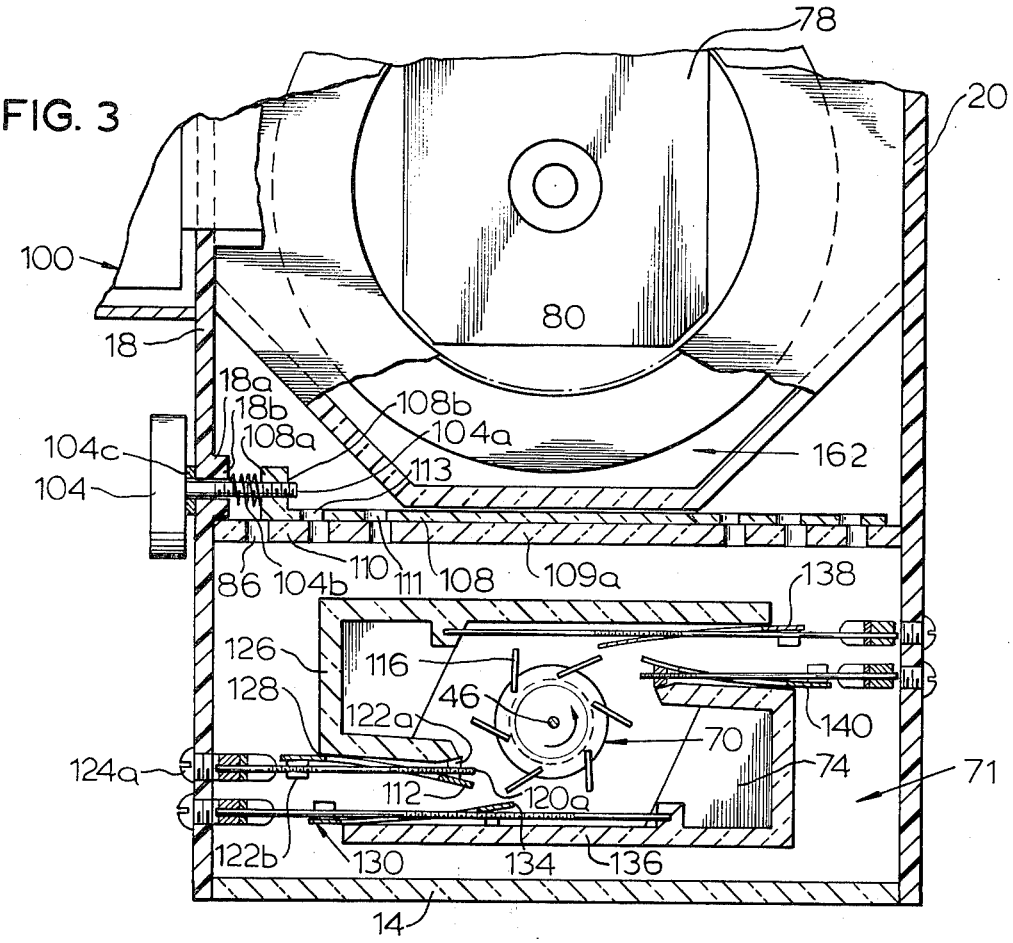
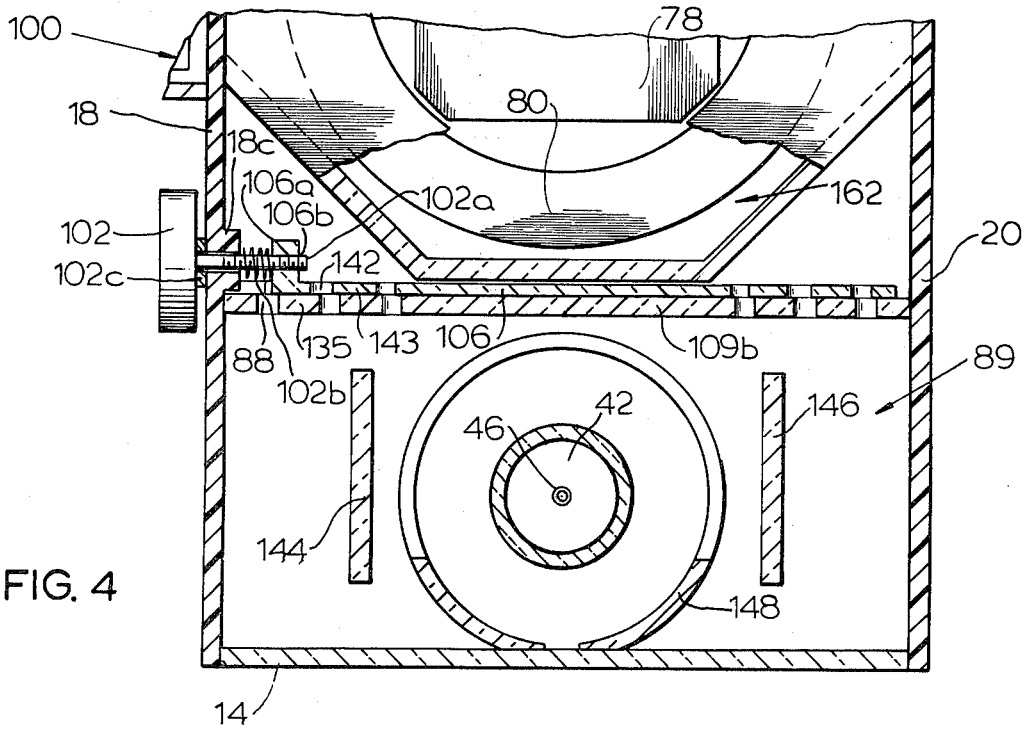
FIG. 4

HERB PROCESSING MACHINE

BACKGROUND OF THE INVENTION

1. Field of the Invention

This invention relates to an herb processing machine, and further and more particularly to a portable machine capable of separating the leaf portions of herbal material from the stems, seeds and twigs in a batch-type process.

2. Description of the Prior Art

The broad concept of processing dried plant substances to break down the plant substance into its component parts consisting of leaf, twigs, stems and seeds and for separating the leaf from the remaining components is broadly old. Further, it is known to use an air stream, the volume of which is adjusted by means of various valves so that the light leafy material will be carried by the air stream to a point of utilization and the heavier undesirable twigs, stems and seeds will fall downwardly.

U.S. patents disclosing these general concepts are: U.S. Pat. Nos. 3,661,159; 3,557,799; and 3,548,839. These prior art patents all disclose a large stationary continuous feed processing machine for use in the tobacco industry. These patent disclosures do not address the need for a small portable batch-type machine which can be used to process herbel material on a small scale.

SUMMARY OF THE INVENTION

The present invention provides a small portable machine which can be used in industry, laboratories or in the home for processing herbal materials to separate the leaf portions from the stems, seeds and twigs in small batch amounts.

The compact machine is provided with a vertically disposed feeding chamber which communicates with an expandable stripping chamber wherein the leaf material is separated from the stems, seeds and twigs. An air stream is directed upwardly through the stripping chamber and continues through an expandable conduit to a collection chamber. In the collection chamber the air exits through a screen portion in the wall and the leaf material is deposited in a removable container.

When the batch is processed, the leaf material is removed from the container for further use and the container is replaced on the machine. The velocity of the air stream is selectively increased to flush the stems, seeds and twigs from the stripping chamber through the conduit into the collection chamber where they are deposited into the collection container for removal and disposal.

The stripping chamber is comprised of a generally cylindrical and axially expandable chamber being open on both ends for passage of the air stream therethrough and has a horizontally disposed wire member which rotates about a central vertical axis in a plane perpendicular to the axis of the cylindrical chamber, wherein the rotating wire knocks the leaf material loose from the stems, seeds and twigs. The rotating wire is driven by a fan arrangement located in the path of an air stream.

A single source of air under pressure may supply the air stream for driving the rotating wire and the air stream for carrying the leaf material. Various valves are provided for selectively adjusting the velocity of the air stream passing through the stripping chamber for selectively carrying herbal materials of differing densities at different stages in the processing of the herbal material.

The present invention provides that the stripping chamber and the conduits be of a telescoping coaxial two wall construction so as to permit the stripping chamber and the conduits to be selectively axially elongated to provide for differing batch sizes to be processed and selectively detached to provide for access to the interior of the machine for purposes of cleaning, etc. Further, the expandability of the stripping chamber and the conduit permits the portable machine to be stored in a more compact size during periods of non-use thereby greatly enhancing its practicality without restricting its usefulness.

DESCRIPTION OF THE DRAWINGS

FIG. 1 is a side elevational view partially cut-away to show the interior of the portable herb processing device of the present invention shown in the compact form, i.e., a closed position.

FIG. 3 is a partial cross-sectional view showing the wire driving mechanism taken along lines III—III of FIG. 2.

FIG. 4 is a cross-sectional view showing the slide valves for controlling the velocity of the air stream through the stripping chamber taken along lines IV—IV of FIG. 1.

FIG. 5 is a partial cross-sectional view showing the rotating stripping wire taken along lines V—V of FIG. 2.

FIG. 6 is a partial cross-sectional view detailing how the collection container attaches to the collection chamber and is taken along lines VI—VI of FIG. 1.

DESCRIPTION OF THE PREFERRED EMBODIMENTS

Figure 2:
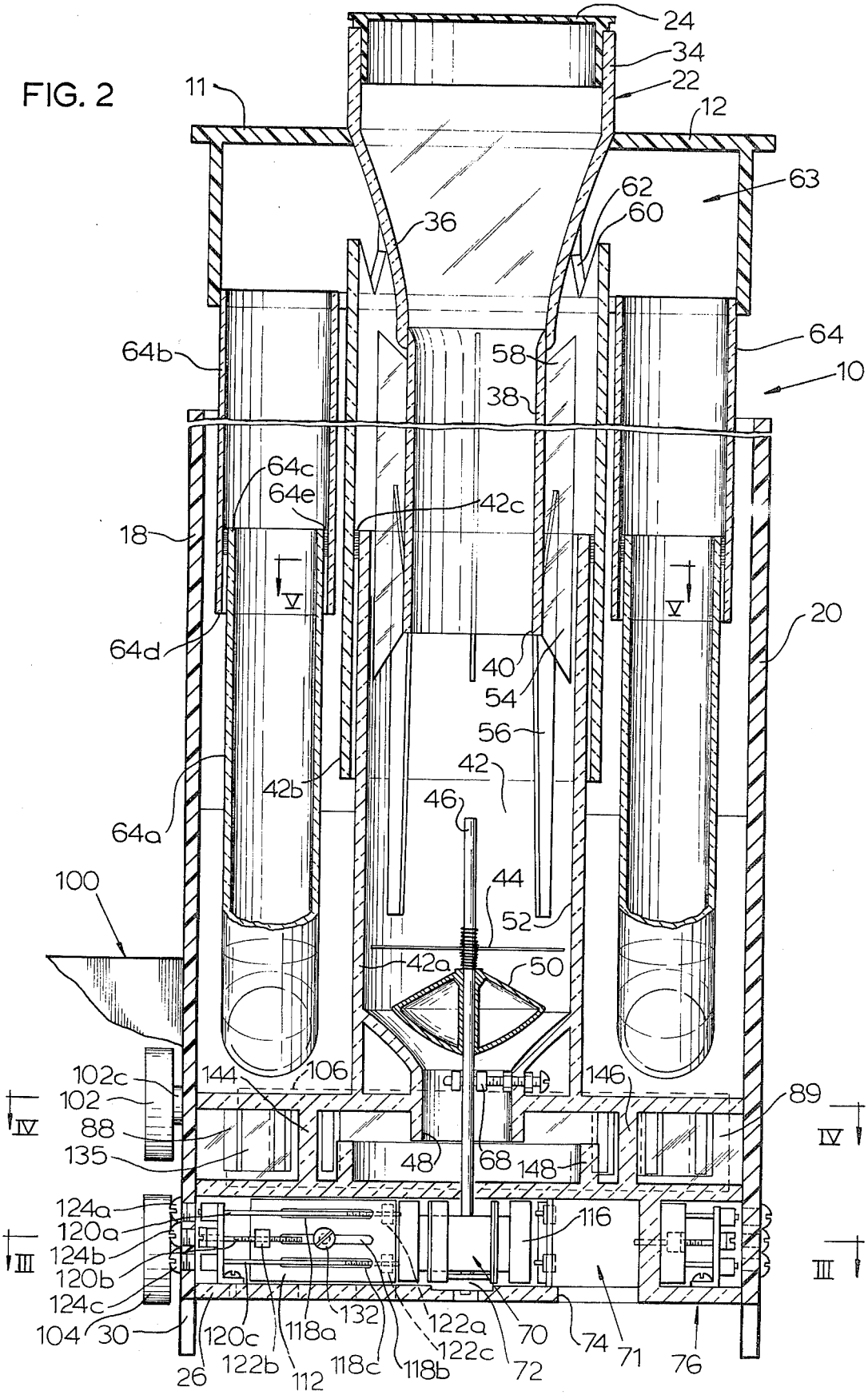
FIG. 2 is a cross-sectional view of the device taken along lines II—II of FIG. 1 shown in the elongated form, i.e. an extended position.

FIG. 1 shows a portable herb processing machine generally at 10 which is comprised of a box type housing 11 having a top wall 12, a bottom wall 26, a rear wall 16 and side walls 18, 20. The front 14 of the housing 11 is open. In its compact storage form, the size of the box-like housing 11 is approximately 30 cm (12 inches) tall by 18 cm (7 inches) wide and 25 cm (10 inches) deep.

Projecting above the top wall 12 is the top of a generally cylindrical feeding chamber 22 having a diameter of about 8 cm (3 inches) which is selectively sealed by a removable cap 24. The bottom wall 26 of the herb processing machine 10 is raised above a supporting surface by leg members 28, 30 having an opening 32 therebetween for the passage of an exhaust air stream.

The interior of the herb processing machine is best seen in FIG. 2. The feeding chamber 22 is comprised of a wide cylindrical upper mouth section 34 which is connected to a conical section 36 forming the throat of the chamber 22. The conical section 36 is in turn connected to a cylindrical section 38 having a diameter smaller than the mouth section 34 of the feeding chamber 22. The 8 cm (3 inch) opening is thereby reduced to about a 5 cm (2 inch) diameter cylinder 38.

A lower end 40 of the cylindrical section 38 is open to a stripping chamber 42 which has near the bottom thereof, a rotatable wire 44 extending perpendicular to a drive shaft 46 which is disposed generally along the axis of the cylindrical stripping chamber 42. The stripping chamber 42 is open at a bottom end 48 thereof for passage of an air stream therethrough. An air stream deflector means 50 is provided between the open bottom end 48 of the stripping chamber 42 and the rotatable wire 44 to direct the air stream along a circumferential wall 52 of the stripping chamber 42.

The diameter of the stripping chamber 42 being approximately 8 cm (3 inches) is greater than the diameter of the cylindrical section of the feeding chamber 22 such that the cylindrical section of the feeding chamber 22 is coaxially carried within the stripping chamber 42 and a cylindrical passageway 54 is formed between the circumferential wall 52 of the stripping chamber 42 and the cylindrical section 38 of the feeding chamber 22.

Spacing or guide members 56 and 58 are provided between the circumferential wall 52 of the stripping chamber 42 and the cylindrical section 38 of the feeding chamber 22 to retain the feeding chamber 22 coaxially within the stripping chamber 42 and to guide the air flow through the passageway 54 in a laminar manner. The guide members 56 are attached at one side to the circumferential wall 52 and at the other side are adjacent to but not attached to the cylindrical section 38. The guide members 58 are attached at one side to the cylindrical section 38 and at the other side are adjacent to but not attached to the circumferential wall 52.

The stripping chamber 42 is comprised of two cylindrical coaxial walls **42*a*, 42*b*, such that the lower smaller cylinder 42*a* is carried within the upper larger cylinder 42*b*. The mating ends 42*c*, 42*d* of the two cylinders are open such that there is unimpeded communication between the two mating cylinders. A sealing means 42*c* is provided between the two cylinders 42*a*, 42*b* to provide for an air tight chamber 42**.

The stripping chamber 42 can thus be axially expanded or elongated to provide for differing batch sizes to be processed in the machine. Further, the machine can be collapsed to a compact size for storing during periods of non-use. The coaxial walls **42*a*, 42*b* also provide access to the interior of the housing 11 in that the walls 42*a* and 42*b* can be completely detached thus removing the top portion of the housing 11** from the bottom portion.

An upper end 60 of the cylindrical passageway 54 is open as at 62 adjacent the throat section 36 of the feeding chamber 22 and communicates at an air chamber 63 with a pair of conduits 64, 64 where the direction of the air flow is reversed. As seen in FIG. 1, the conduits 64, 64 communicate at an opposite end 66 with a collection chamber 68.

The conduits 64 are also comprised of two cylindrical coaxial walls **64*a*, 64*b*, such that the lower smaller cylinder 64*a* is carried within the upper larger cylinder 64*b*. The mating ends 64*c*, 64*d* of the two cylinders are open such that there is unimpeded communication between the two mating cylinders. A sealing means 64*e* is provided between the two cylinders 64*a*, 64*b* to provide for an air tight conduit 64. The cylindrical walls 64*a* and 64*b* may be completely detached similarly to the walls 42*a*, 42*b* described above to facilitate in the removal of the top portion of the housing 11 from the bottom portion. Although the lower cylinder 64*a* is shown as being smaller than the upper cylinder 64*b*, the upper cylinder could be smaller and carried within the lower cylinder 64*a***.

Referring back to FIG. 2, the drive shaft 46 which carries the rotatable wire 44 is journaled in a bearing 68 which is retained in the center of the stripping chamber by appropriate means. The drive shaft 46 is rotatably driven by a fan blade arrangement or motor 70 located in a lower compartment 71 of the housing 11 at which an air stream is directed. The drive shaft 46 and connected fan blade arrangement 70 are seated in the bottom wall 26 of the herb processing machine 10 against a bearing 72. After the air stream drivingly passes the fan blade arrangement 70, it exits from the interior of the herb processing machine 10 through an exhaust port 74 into a space 76 below the bottom wall 26 of the herb processing machine 10 and then exits between the leg portions 28, 30 through the opening 32 therebetween.

Figure 7:
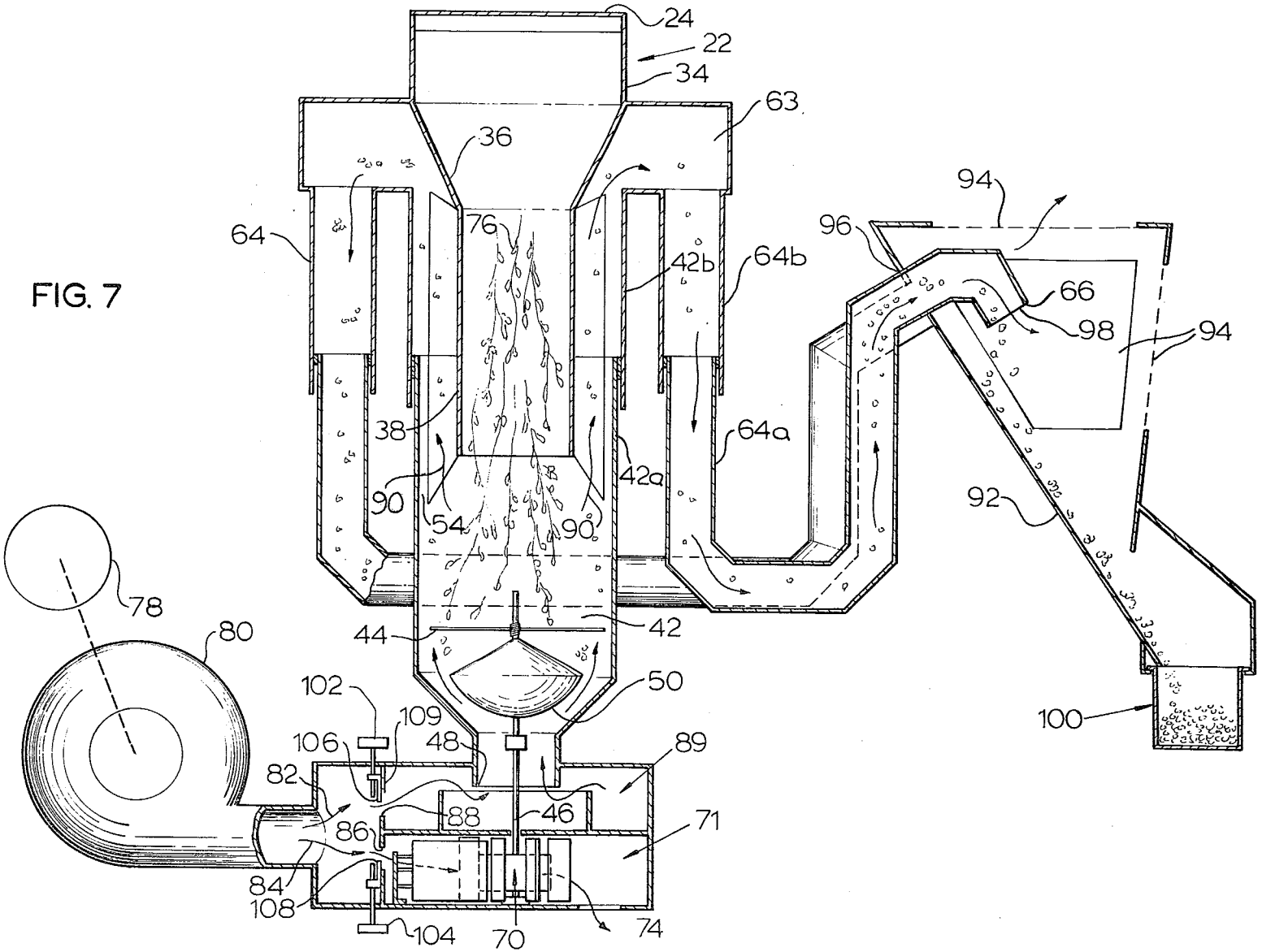
FIG. 7 is a diagrammatic view of the device shown in FIG. 1 illustrating a flow diagram for the device.

Referring to FIG. 7, which shows a diagramatic view of the portable herb processing machine 10, under the principles of the invention, the first step in utilizing the machine is to remove the cap 24 from the top of the feeding chamber 22. A batch of herbal material 76 is introduced into the mouth portion 34 of the feeding chamber 22 and the cap is replaced thereon. A motor 78 drives a fan or blower 80 which introduces air under pressure in the form of an air stream to the interior of the herb processing machine 10 as at arrows 82, 84.

The air stream is then split into two different streams, one represented by arrow 84 which flows through opening 86 into lower compartment 71 to drive the fan blade arrangement 70 which is connected to the drive shaft 46. This air stream then exits from the lower compartment 71 through opening 74 into atmosphere.

The second portion of the air stream represented by arrow 82 flows through opening 88 into an upper compartment 89 below the stripping chamber 42 and is directed through the opening in the bottom end 48 of the stripping chamber 42. The air stream deflector means 50 urges the air stream towards the circumferential wall 52 of the stripping chamber where it flows upwardly through the cylindrical passageway 54 between the circumferential wall 52 of the stripping chamber 42 and the cylindrical section 38 of the feeding chamber 22 as at arrow 90.

As the herbal material 76 falls downwardly through the conical throat section 36 and the cylindrical section 38 of the feeding chamber 22 into the stripping chamber 42, it comes into contact with the rotating wire 44. The rotating wire 44 strips the leaf portions away from the stems, seeds and twigs of the herbal material by a shearing action. The light leafy material is then caught in the air stream directed upwardly along the circumferential wall 52 as at 90 and is carried by the air stream through the conduits 64 into a collection chamber 92. The heavier stems, seeds and twig portions of the herbal material 76 remain in the stripping chamber 42 as they are too dense for the air stream to carry upwardly through the annular passageway 54.

The collection chamber 92 has provided in its walls a plurality of screened apertures 94 which allow the air under pressure to escape from the collection chamber 92 while retaining the leaf portions of the herbal material 76 within the interior of the collection chamber 92. The conduit 64 enters into the collection chamber 92 as at 96 and has an opening 98 at an end thereof which is positioned so as to cause the leafy material to be directed downwardly toward a removable collection container 100.

After the leafy material has been separated from the stems, seeds and twigs in the stripping chamber 42 and has been carried by the air stream through the conduit 64 into the collection chamber 92 and has been deposited in the collection container 100, the collection container 100 is disengaged from the herb processing machine 10 and the leafy contents are removed therefrom for further processing and use. The collection container 100 is then re-engaged with the herb processing machine and the velocity of the air stream passing through the upper compartment 89 and the stripping chamber 42 is selectively increased.

Control knobs 102, 104 are provided to adjust valves 106, 108 which in turn control the amount and velocity of the air flowing through the lower compartment 71 past the fan blade arrangement 70 and through the upper compartment 89 up through the stripping chamber 42. As less air is provided for the fan blade arrangement 70 by operating knob 104 which adjusts valve 108 to close opening 86, more air flows through opening 88 which then continues through the stripping chamber 42 in an increased velocity.

The increased air flow velocity through the stripping chamber 42 has sufficient force to carry upwardly the denser herb portions such as the stems, seeds and twigs through the annular passageway 54, the conduit 64 and into the collection chamber 92 to be deposited in the collection chamber 100 for removal and disposal.

Although different forms of valve mechanisms could be employed for purposes of air flow control, a particularly advantageous embodiment is shown in FIG. 3. The interior of the housing 11 is partitioned by a wall 109, thereby separating the upper compartment 89 and a lower compartment 71 from a motor and blower compartment 162. The lower portion **109*a* of the wall 109 is particularly characterized by having formed therein a plurality of valve passages or openings 86 thereby providing alternate openings 86 and lands 110** for effecting valve controlled flow therethrough.

A valve slide member 108 of lesser length than the length of said wall **109*a* is mounted for controlled movement relative to said wall 109*a*. The valve slide member 108 has a corresponding plurality of openings 111 with alternating control lands 113 so that the valve slide 108** can be adjusted selectively in varying degrees of registration.

In order to provide such adjustability, there is provided an upright flange **108*a* at one end of the slide valve through which extends a threaded opening 108*b* adapted to matingly receive a correspondingly threaded stud 104*a* rotatably actuated by a knob 104 disposed on the outside of the housing 11 on the side wall 18. The side wall 18 is formed with an enlarged boss 18*a* apertured as at 18*b* to pass the stud 104*a*. A coil spring 104*b* surrounding the stud is bottomed against the flange and against the boss 18*a*, thereby preloading the adjustment means and allowing any selected mode of adjustment to be locked in place. A washer 104*c* is provided between the knob 104 and the wall 18** to prevent binding.

Air under pressure leaves the blower 80 and exits from the motor and blower compartment 162 through the wall 109, and into upper and lower compartments 89 and 71. The air under pressure flowing into the lower compartment 71 is then directed between two adjustable guides 112, 134 towards blades 116 of the fan blade arrangement 70.

Guide 112 is generally a rectangular flat piece of flexible material, as seen in FIGS. 2 and 3, with three central slot type apertures **118*a*, 118*b* 118*c* for passage of three threaded rods 120*a*, 120*b* and 120*c*** therethrough.

Slot **118*b* is centrally located with slots 118*a* and 118*c* disposed parallel thereto on either side. Slot 118*b* receives threaded rod 120*b*. Rod 120*b* is threaded through a block 122*b* having mating internal threads therethrough and which is permanently attached to guide 112. Rod 120*b* may be rotatingly driven by means of a screw head 124*b*, such that rotation of rod 120*b* causes guide 112 to move left or right as viewed in FIG. 2**.

Threaded rods **120*a*, 120*c* are received through slots 118*a*, 118*c* and carry thereon internally threaded blocks 122*a*, 122*c*. The blocks 122*a*, 122*c* are sized to be wider than slots 118*a*, 118*c*** so as not to pass therethrough.

The rods **120*a*, 120*b* and 120*c* are disposed in the front of guide 112 on the left side and then pass through the slots 118*a*, 118*b* and 118*c* to be disposed in the rear of the guide 112 on the right side thereof. Block 122*b* is carried on the front of the guide 112 while blocks 122*a*, 122*c* are positioned behind the guide 112. The left rear side of the guide 112 abuts against a fixed baffle wall 126. Blocks 122*a*, 122*c* are positioned between the baffle wall 126 and the guide 112** so as to be nonrotatable.

Screw heads **124*a*, 124*c* are provided to rotatingly drive rods 120*a*, 120*c*. As rods 120*a*, 120*c* are rotated, blocks 122*a*, 122*c* are caused to move left or right on the rods 120*a*, 120*c* resulting in a deflection of guide 112 about a point of contact 128 between guide 112 and wall 126. As blocks 122*a*, 122*c* are moved to the left, the deflection of the guide is increased. An additional screw 132 may be provided to be located in slot 118*b* to retain guide 112** in a fixed position and to increase the deflection of the guide.

A complementary guide assembly 130 having the same components as described above including guide member 134, is provided adjacent guide 112 such that the two guide members 112, 134 are deflected toward each other and form a path therebetween for a stream of air.

By adjusting guide 112 and 134, an optimum air flow can be achieved for drivably rotating the fan blade arrangement 70 which in turn drives the drive shaft 46 and the rotating wire 44.

A second baffle wall 136 is provided to work in conjunction with the baffle wall 126 in further partitioning the lower compartment 71 and directing the air flow from the blower 80 between the guides 112, 134.

A second set of guides 138, 140 are constructed and operated in a manner similar to guides 112 and 134. While the drawing shows two sets of guides employed for directing the air stream toward the blades 116, it should be understood that one or more sets of guides may be employed consistant with the principles of my invention.

FIG. 4 shows in detail the upper portion **109*b* of the wall 109 which is characterized by having formed therein a plurality of valve passages or openings 88 thereby providing alternate openings 88 and lands 135** for effecting valve controlled flow therethrough.

The valve slide member 106 is similar to valve slide member 108 in that it is of lesser length than the length of the wall **109*b* and is mounted for controlled movement relative to said wall 109*b*. The valve slide member 106 has a corresponding plurality of openings 142 with alternating captive lands 143 so that the valve slide 106** can be adjusted selectively in varying degrees of registration.

In order to provide such adjustability, there is provided an upright flange **106*a* at one end of the slide valve through which extends a threaded opening 106*b* adapted to matingly receive a correspondingly threaded stud 102*a* rotatably actuated by a knob 102 disposed on the outside of the housing 11 on the side wall 18. The side wall 18 is formed with an enlarged boss 18***c* apertured as at 18*d* to pass the stud 102*a*. A coil spring 102*b* surrounding the stud is bottomed against the flange 106*a* and against the boss 18*c*, thereby preloading the adjustment means and allowing any selected mode of adjustment to be locked in place. A washer 102*c* is provided between the knob 102 and the wall 18 to prevent binding.

The air under pressure which leaves the blower 80 and exits from the motor and blower compartment 162 through the wall 109*b*, and into the upper compartment 89 through the valve means just described continues through the opening at the bottom 48 of the stripping chamber 42 and through the path previously described. Baffle walls 144, 146 and 148 are provided to ensure a proper air flow up through the opening at the bottom 48 of the stripping chamber 42.

Referring to FIG. 5, it is seen how the rotating wire 44 is positioned within the stripping chamber 42. Also, more clearly shown is the cylindrical passageway 54 which is between the circumferential wall 52 of the stripping chamber 42 and the cylindrical section 38 of the feeding chamber 22. Positioned longitudinally in the cylindrical passageway are the spacing or guide members 56, 58 which guide the air flow and space the walls especially as the stripping chamber 44 is being elongated or compacted.

FIG. 6 shows in detail the means by which the collection container 100 is engaged with the collection chamber 94. The collection container 100 is comprised of side walls 150, 152 having ears 154, 156 at a top end thereof. Slots 158, 160 are provided in receiving walls 163, 164 of the collection chamber 94. The collection container 100 is positioned at a bottom end of a sloping sidewall 166 of the collection chamber such that pieces of herbal material which are deposited in the collection chamber 92 fall downwardly along the sloping sidewall 166 and are collected in the collection container 100. The collection container 100 can then be slidingly removed form the slots 158, 160 for removal of the contents therein.

It is contemplated at least the side walls 18, 20, the conduits 64 and the circumferential wall 52 be made of a transparent plastic material so that the processing of the herbal material 76 may be readily viewed during the processing to aid the adjustment of the various valves and so that the progress of the processing can be visually monitored.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A portable herb processing machine comprising:

a housing sized to be carried by an operator and operable on a counter top;

wall means partitioning the interior of said housing into a centrally disposed upright cylindrical stripping chamber, a lower fan blade motor compartment, and an intermediate air passage compartment;

a motor and blower unit in said housing discharging a stream of pressurized air, means spliting said stream of air into said fan blade motor compartment and into said air passage compartment;

a drive shaft extending upwardly and extending successively through said air passage compartment and into said stripping chamber;

a fan blade motor connected to said drive shaft in said lower fan blade motor compartment and being rotatably driven by an air stream from said motor and blower unit;

stripping wire and air flow deflector means corotatably connected to said drive shaft in said stripping chamber;

means forming an inlet throat between said air passage compartment and said stripping chamber;

a feeding tube telescopically insertable into said stripping chamber;

guide means between said feeding tube and said stripping chamber to guide and retain said tube in adjusted axial position and forming air passages disposed in an annulus around said feeding tube;

a generally inverted cup shaped cover member carrying said feeding tube and forming an intermediate air chamber into which the air passages discharge, conduit means in said housing including telescoping sections for accommodating vertical movement of said feeding tube and having one end connected to said intermediate air chamber and the other end leading to another portion of said housing;

a collection chamber formed in said housing into which said conduit means discharge, and air valve control means operable from the exterior of said housing to control the flow of air into said fan blade motor compartment and into said air passage compartment;

whereby a supply of herbs may be introduced into the feeding tube while the stripping and air deflector means are rotating so that the leafy portions will be separated and blown upwardly in said passage for removal to the collector chamber.

2. A portable plant material processing machine comprising:

a housing sized to be carried by an operator and operable on the counter top;

wall means partitioning the interior of said housing into a centrally disposed upright cylindrical stripping chamber, a lower fan blade motor compartment, and an intermediate air passage compartment;

a motor and blower unit in said housing discharging a stream of pressurized air, means splitting said stream of air into said fan blade motor compartment and into said air passage compartment;

a drive shaft extending upwardly and extending successively through said air passage compartment and into said stripping chamber;

means forming an inlet throat between said air passage compartment and said stripping chamber;

a fan blade motor connected to said drive shaft in said lower fan blade motor compartment and being rotatably driven by an air stream from said motor and blower unit;

a stripping means rotatably connected to said drive shaft in said stripping chamber;

a feeding tube inserted into said stripping chamber;

conduit means in said housing having one end connected to said stripping chamber and the other end leading to another portion of said housing;

a collection chamber formed in said housing into which said conduit means discharge;

whereby a supply of plant material may be introduced into the feeding tube while the stripping means is rotating so that the leafy portions will be separated and blown upwardly in said passage for removal to the collection chamber.

3. The device of claim 2, wherein said machine is at least partially constructed of a transparent plastic material such that the processing steps in the stripping chamber and the conduit can be visually monitored during the operation.

4. The device of claim 2, wherein the stripping chamber and the conduit may be slidingly elongated and selectively detached to allow for larger amounts of plant material to be processed at one time and to provide access to the interior of the said plant material processing machine.

5. The device of claim 2, and including air valve control means operable from the exterior of said housing to control the flow of air into said fan blade motor compartment and into said air passage compartment whereby the velocity of the air stream into said air passage compartment can be selectively adjusted for carrying plant materials of differing densities at different stages in the processing of the plant material.

6. The device of claim 2 including an air flow deflector means mounted below and corotatable with said stripping means on said drive shaft whereby said air stream is directed along said wall means of said stripping chamber and into said conduit means.

7. A portable plant material processing machine comprising:

a housing sized to be carried by an operator and operable on a counter top;

wall means partitioning the interior of said housing into a centrally disposed upright cylindrical stripping chamber, and an intermediate air passage compartment;

rotatable stripping means carried in said stripping chamber;

a motor and blower unit in said housing discharging a stream of pressurized air into said air passage compartment;

means forming an inlet throat between said air passage compartment and said stripping chamber;

a feeding tube being telescopically insertable into said stripping chamber;

means for adjusting the axial position of the feeding tube in the stripping chamber;

guide means between said feeding tube and said stripping chamber to guide and retain said tube in an adjusted axial position and forming air passages disposed in an annulus around said feeding tube;

conduit means in said housing having one end connected to said stripping chamber through said air passages and the other end leading to another portion of said housing;

a collection chamber formed in said housing into which said conduit means discharge;

whereby a supply of plant material may be introduced into the feeding tube while the stripping means is rotating so that the leafy portions will be separated and blown upwardly in said passage for removal to the collector chamber.

8. The device of claim 7, wherein the rotating stripping means is driven by a fan blade arrangement located in the path of an air stream.

9. The device of claim 8, wherein a single source of air under pressure supplies said air stream for driving said rotating stripping means and said air stream for carrying said leaf meterial.

* * * * *